US005482374A

United States Patent [19]

Buhyoff

[11] Patent Number: 5,482,374

[45] Date of Patent: Jan. 9, 1996

[54] BEACH TOWEL/CARRY BAG

[75] Inventor: Todd J. Buhyoff, Saratoga, Calif.

[73] Assignee: Innovision, Inc., Saratoga, Calif.

[21] Appl. No.: 202,914

[22] Filed: Feb. 28, 1994

[51] Int. Cl.[6] ..... B65D 30/10

[52] U.S. Cl. ..... 383/4; 383/75; 5/417

[58] Field of Search ..... 383/4, 75, 907; 5/417

[56] References Cited

U.S. PATENT DOCUMENTS 2,479,203 8/1949 Brown .
4,738,545 4/1988 Westgor .
4,794,029 12/1988 Tennant et al. .
4,856,912 8/1989 Damus et al. .
4,914,767 4/1990 Balicki et al. .
4,991,978 2/1991 Ostrowski .
5,187,823 2/1993 Ferguson et al. ..... 383/4 X

FOREIGN PATENT DOCUMENTS 0578247 1/1994 European Pat. Off. ..... 383/4

*Primary Examiner*—Jes F. Pascua
*Attorney, Agent, or Firm*—David H. Jaffer

[57] ABSTRACT

A beach towel constructed with a polygonal center panel from which extend separate trapezoidal panels creates a towel with a substantially polygonal perimeter. The panels are sewn together to provide a strong reinforced structure, and a drawstring around the perimeter permits conversion of the towel into a bag-like structure.

3 Claims, 3 Drawing Sheets

BEACH TOWEL/CARRY BAG

BACKGROUND OF THE INVENTION

1. Field of the Invention

This invention relates generally to an improved beach towel/carry bag, and more particularly to a beach towel/carry bag constructed with a polygonal outer panel from which extend trapezoidal panels, thereby simplifying assembly and strengthening the towel/bag.

2. Brief Description of the Prior Art

Circular and polygonal beach towels are known in the prior art, as are towels which convert into carry bags with a draw cord. Ostrowski (U.S. Pat. No. 4,991,978) shows a circular towel bag with a draw string. Balicki et al. (U.S. Pat. No. 4,914,767) show an octagonal beach blanket large enough so that the blanket does not have to be moved as the sun moves. Damus et al. (U.S. Pat. No. 4,856,912), Tennant et al. (U.S. Pat. No. 4,794,029), Westor (U.S. Pat. No. 4,738,545), and Brown (U.S. Pat. No. 2,479,203) all show towels or sheets with a draw string for conversion into bags.

SUMMARY OF THE INVENTION

It is a primary object of the present invention to provide a combination beach towel/tanning blanket, draw string "carry all" transport sack, and an on-site privacy bag/blanket in which the user can fully enclose his or her body in the event the user wants to change clothes or be protected from wind or cold.

Another object of the present invention is to provide a beach blanket/carry bag with rugged construction for carrying items and with a form that simplifies assembly and strengthens the towel.

A further object of the present invention is to provide a beach blanket/carry bag which may be converted into an umbrella with a telescopic pole and draw cords.

Still another object of the present invention is to provide a beach blanket which may be converted into a carry bag or privacy bag/blanket with an easily sliding cord.

Briefly, the preferred embodiment of the present invention is a beach blanket constructed with a polygonal center panel from which extend separate trapezoidal panels which give the structure a substantially polygonal perimeter. The panels are sewn together to provide a strong reinforced structure. Around the perimeter of the main structure are pockets which contain a draw cord, which may be drawn to convert the towel into a bag-like structure.

These and other objects and advantages of the present invention will no doubt become apparent to those skilled in the art after having read the following detailed description of the preferred embodiment which is illustrated in several figures of the drawing.

IN THE DRAWING

FIG. 4(*b*) is a top view of the telescoping pole shown in FIG. 4(*a*);

DETAILED DESCRIPTION OF THE PREFERRED EMBODIMENT

This invention provides a combination beach towel/carry bag which may also be used as an on-site privacy bag/blanket. The towel/carry bag utilizes a polygonal center panel from which extend separate trapezoidal panels to simplify assembly and strengthen the towel. A telescoping pole allows the towel to be used as an umbrella.

Figure 1:
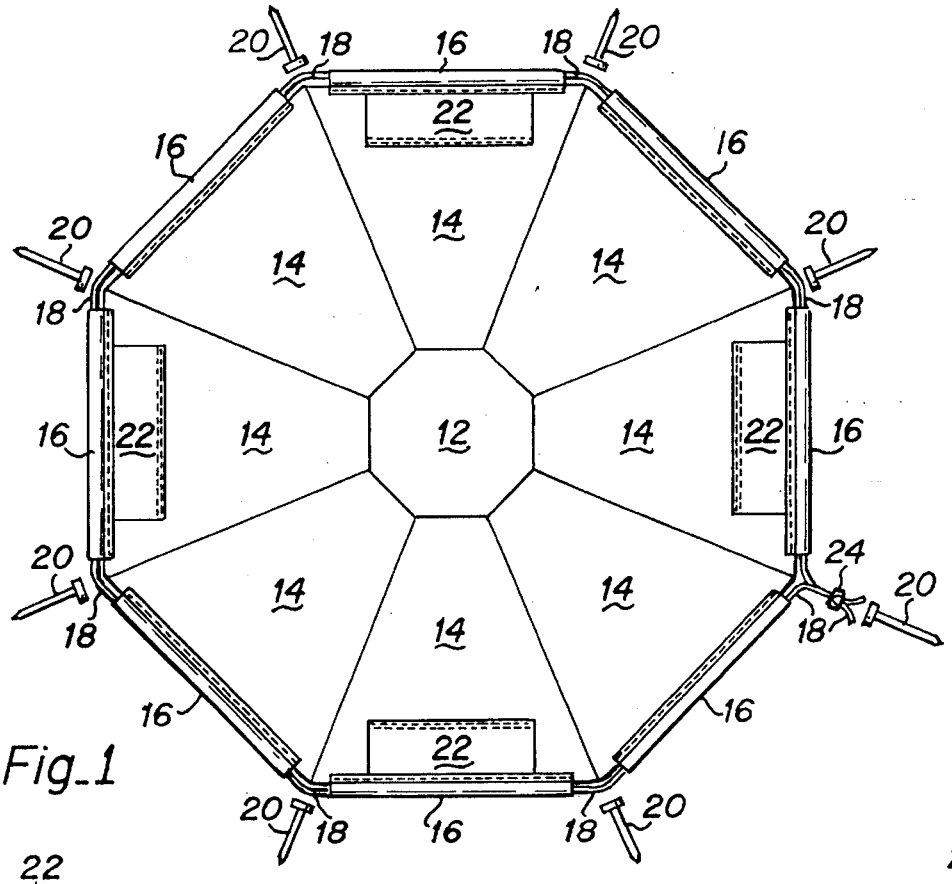
FIG. 1 is a top view of a beach towel/carry bag of the present invention.

With reference to FIG. 1 of the drawing, a top view of the beach towel/carry bag of the present invention is shown. The towel is constructed of a polygonal center panel 12, to which are attached trapezoidal panels 14. In the preferred embodiment, two fabric panels 12 are used back to back, providing a stronger center for the towel. Center panels 12 and trapezoidal panels 14 are sewn together. The sewn panels create a very strong towel, much stronger and more durable than a large piece towel would be. For example, in an octagonal towel as shown in FIG. 1, two center panels and eight trapezoidal panels are sewn together with 16 seams, thereby reinforcing the material to give the product added strength for use as a carry sack. The preferred embodiment of the towel is octagonal, which closely resembles a circle (without an excessive number of panels) and thereby has advantages for use as a carry sack and allows the user to turn with the sun without moving the towel. The octagonal pattern is substantially easier to manufacture than sewing pieces to create a circular pattern.

Eight cord casings 16 surround the perimeter of the trapezoid panels. The cord casings are preferably made of a smooth fabric such as nylon which permits a draw cord 18 to be easily drawn through cord casing 16. Use of a smooth material for the cord 18 such as nylon cord also is preferred. The openings between cord casings 16 permit the cord 18 to be staked down with stakes 20.

In the preferred embodiment, a number of pockets 22 are provided with VELCRO closures. The pockets may be used for storing items such as sunscreens/lotions, keys, wallets, books, etc., or may be stuffed with clothing to make a pillow. A cord lock 24 is provided to lock the cord when it is drawn to create a carry bag out of the towel.

The preferred embodiment includes a carry strap is provided on the backside of the towel for carrying the towel when cord 18 is cinched to create a bag. The strap may have a zippered or velcro pocket for storing a wallet, keys, etc.

Figure 2:
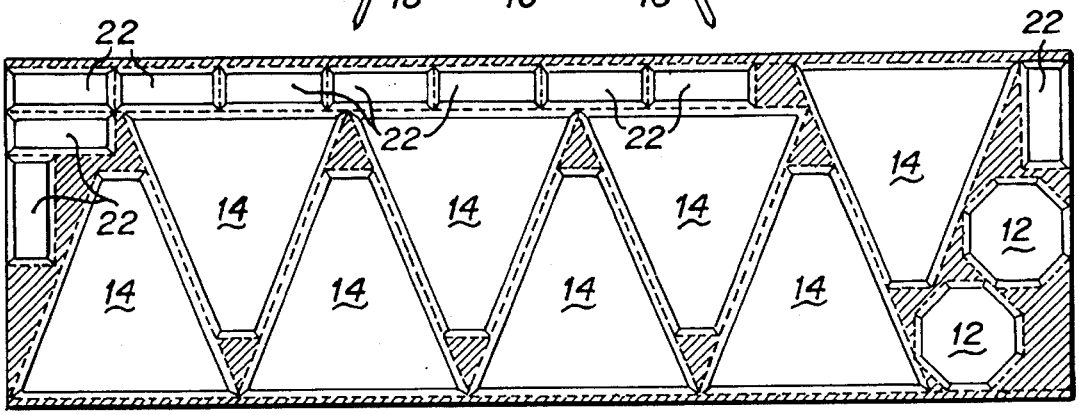
FIG. 2 is a pattern layout for an eight-foot model of the beach towel of the present invention.

Referring now to FIG. 2, a pattern layout for an eight-foot model of an octagonal towel in accordance with the present invention is shown. The shaded areas denote waste material. The length of the material is approximately 198 inches and its width is approximately 62 inches. The pattern layout has eight trapezoidal panels 14, two octagonal center panels 12, and ten panels 22 for creation of the pocket/pillow shown in FIG. 1. Each pocket/pillow in FIG. 1 may be made using one or two panels from FIG. 2. Since FIG. 1 shows only four pockets/pillows, even if two panels are used for each pocket/pillow, there will be two extra panels. The additional panels may be used to attach an additional pocket to the backside of the towel. The backside pocket is out of sight and may be used for storing valuables if the towel is temporarily unattended. Alternatively, the additional panels may be used for creating another pocket/pillow for use with a towel created from a different pattern, such as that shown in FIG. 3.

Figure 3:
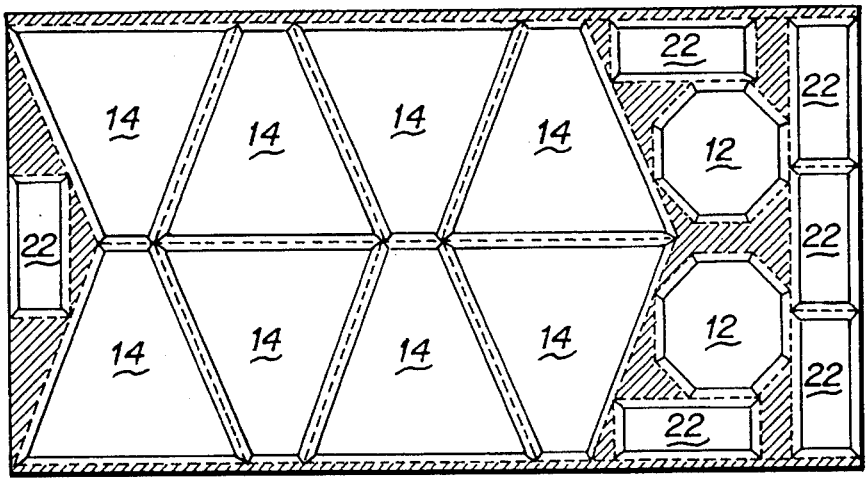
FIG. 3 is a pattern layout for a six-foot model of the present invention.

FIG. 3 shows a pattern layout for a six-foot model of a towel in accordance with the present invention. The material is 62 inches wide by approximately 120 inches long. Since this pattern lacks two of the panels for pocket pillows 22, the excess from the eight-foot model can be used with the six-foot model.

Figure 4A:
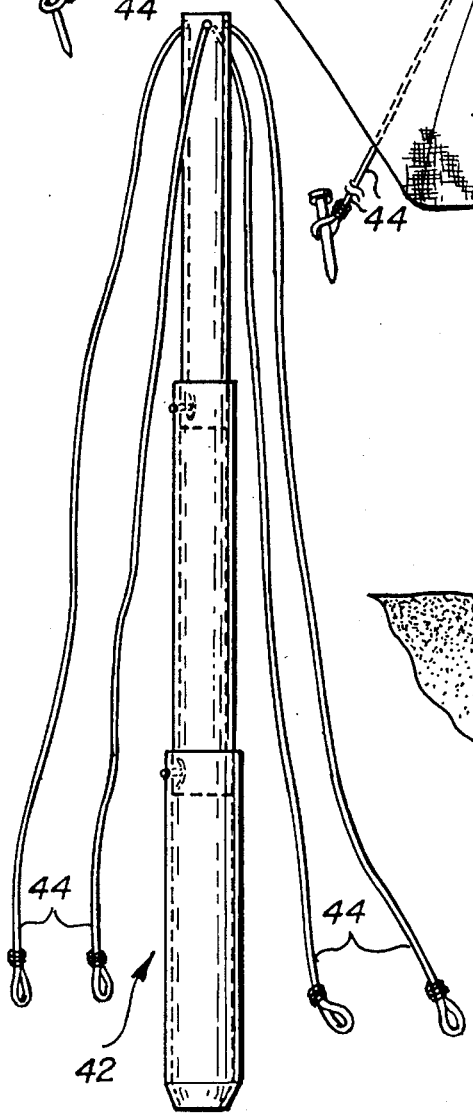
FIG. 4(*a*) is a side view of a telescoping support pole for the towel of the present invention.
Figure 4B:
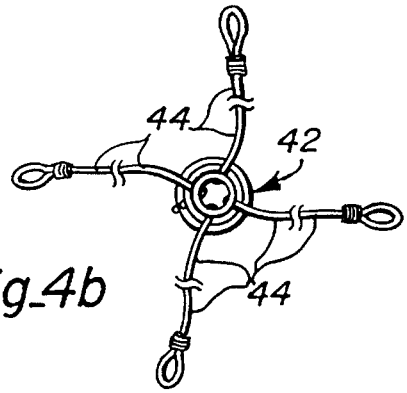

FIGS. 4(*a*) and 4(*b*) illustrate the side and top views of a telescoping pole 42 with support cording 44 which may be used in conjunction with the towel shown in FIG. 1 to provide an umbrella shelter. When telescoping pole 42 is extended and support cording 44 is staked out, the towel may be draped over the pole and support cording to provide an umbrella.

Figure 5:
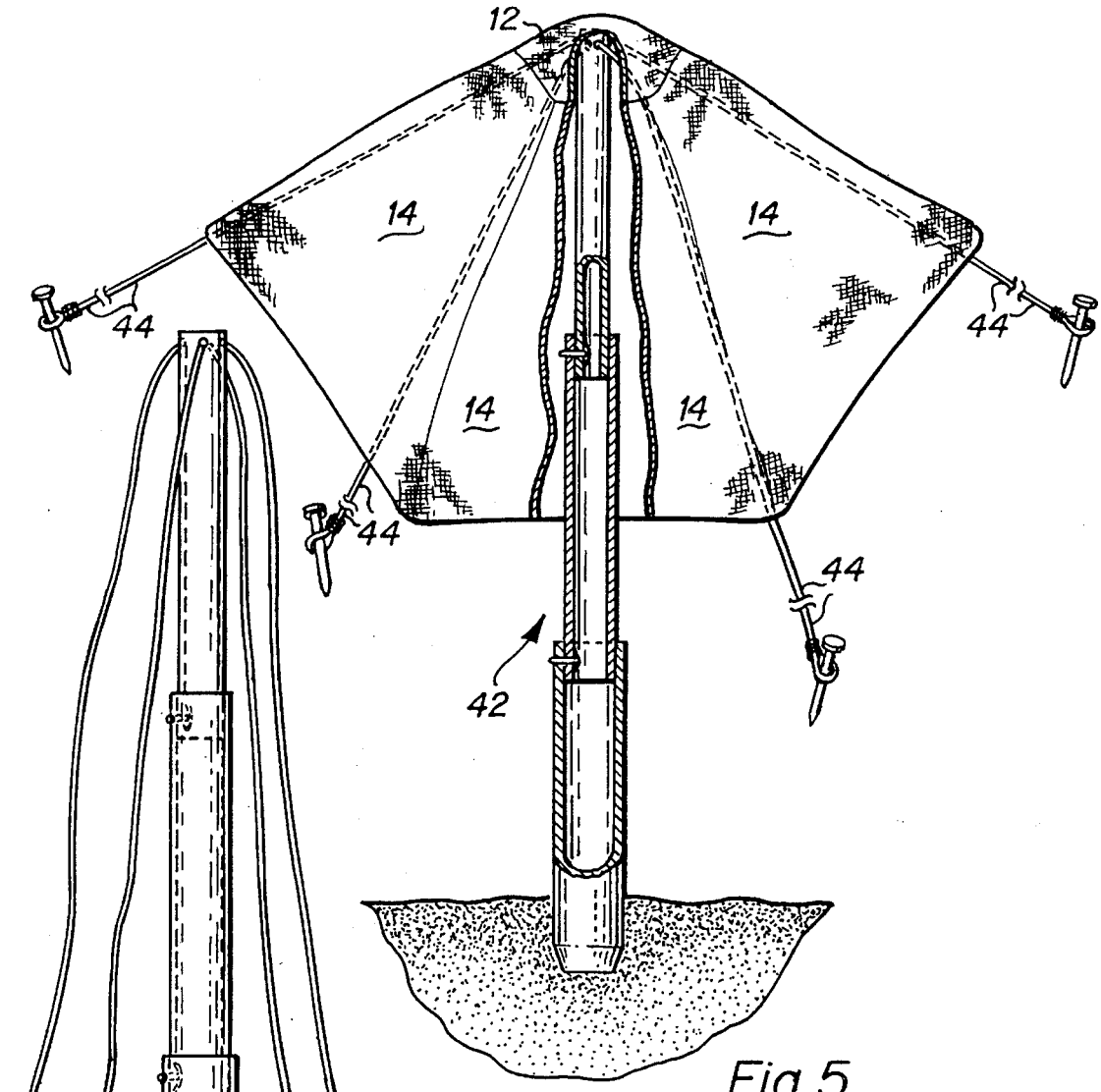
FIG. 5 is a side view of the towel of the present invention with the telescoping pole for supporting the towel.
Figure 6:
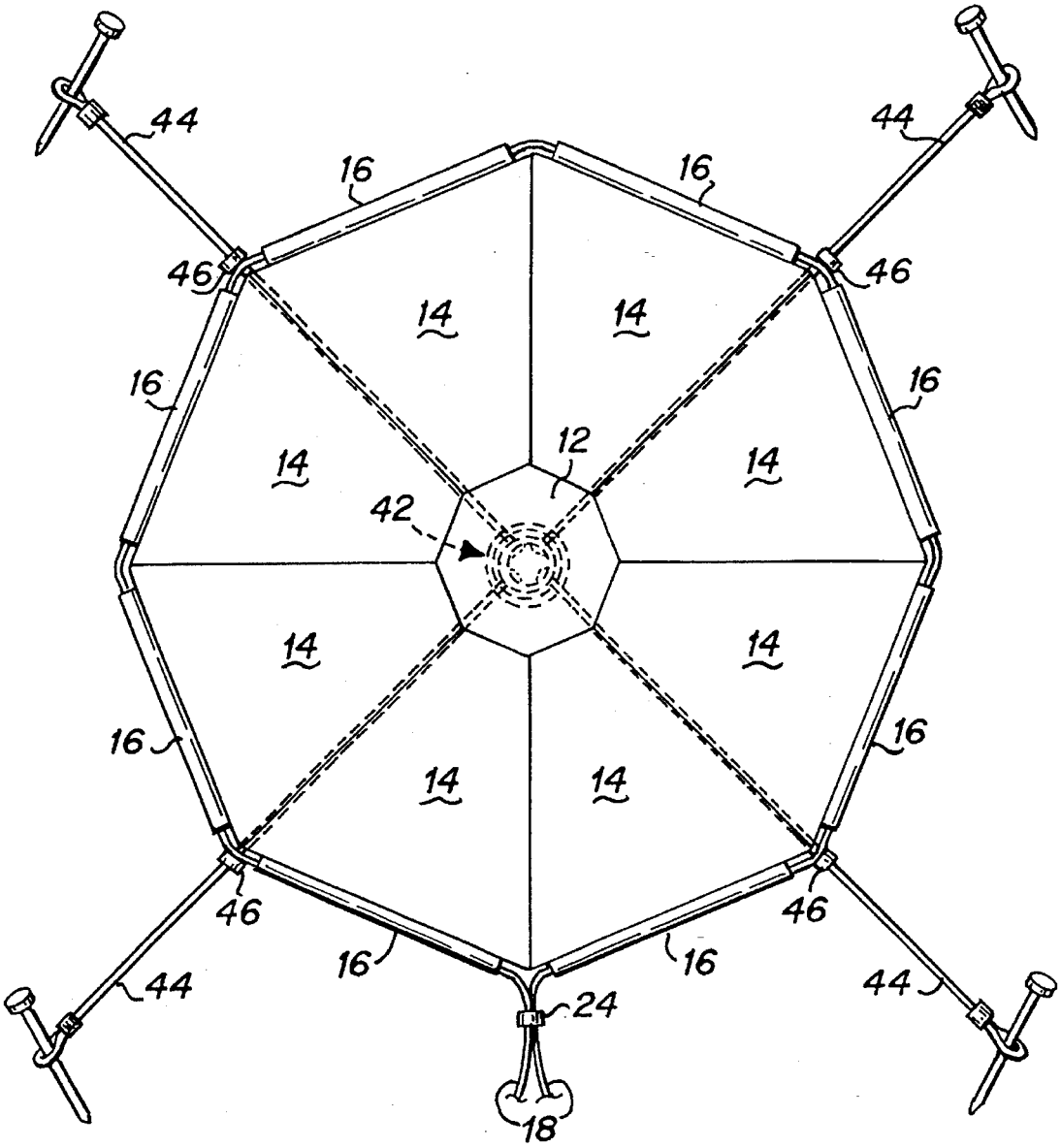
FIG. 6 is a top view of the towel of the present invention used as an umbrella.

FIG. 5 shows how the telescoping pole 42 can be mounted in the sand and the support cording 44 staked out with the towel draped over the support cording and pole. FIG. 6 shows a top view of the towel used as an umbrella. Four S-hooks 46 mounted on support cording 44 are used to secure support cording 44 to the towel by attachment to cord 18 where cord 18 is exposed between segments of cord casing 16.

The eight and six-foot models of the towel in accordance with the present invention are sufficiently large to surround a person when the drawstring is pulled, thereby serving as a changing shield or shield from the weather. They are also sufficiently large that a user need not rotate the towel when the sun's tanning angle has been altered due to the earth's rotation. The user simply rolls his or her body around on the blanket to get into a better position when sun tanning. The numerous panels can be used for various forms of printed advertising and promotion. In addition, the many reinforced seams on the polygonal towel give it sufficient strength for use as a carry sack for transporting heavy objects to and from the beach, a camp site, a laundromat, etc.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A beach towel convertible to a reinforced carry bag, comprising:

(a) a polygonal center panel, said center panel having at least five sides;

(b) a plurality of trapezoidal panels extending from the center panel, the number of trapezoidal panels being at least equal to the number of sides of the center panel, wherein the shorter of the parallel sides of each trapezoidal panel is joined to the perimeter of the center panel to form a seam and each non-parallel side of each trapezoidal panel is joined to the abutting non-parallel side of the adjacent trapezoidal panel to form a seam, thereby reinforcing the towel; and (c) a draw cord around the perimeter of the trapezoidal panels, whereby the towel may be converted to a carry bag when the cord is drawn.

2. The beach towel of claim 1, wherein the number of trapezoidal panels is equal to the number of sides of the center panel.

3. The beach towel of claim 2, wherein the sides of the center panel are of approximately equal length, the shorter of the parallel sides of each trapezoidal panel is approximately equal in length to the length of a side of the center panel, and said shorter sides are joined to the center panel such that the seams joining the non-parallel trapezoidal sides bisect the angles of the center panel.

* * * * *